US005966967A

United States Patent [19]

Agrawal et al.

[11] Patent Number: 5,966,967

[45] Date of Patent: Oct. 19, 1999

[54] EFFICIENT PROCESS TO PRODUCE OXYGEN

[75] Inventors: Rakesh Agrawal, Emmaus; Donn Michael Herron, Fogelsville; Yanping Zhang, Wescosville, all of Pa.

[73] Assignee: Air Products and Chemicals, Inc., Allentown, Pa.

[21] Appl. No.: 09/012,074

[22] Filed: Jan. 22, 1998

[51] Int. Cl.[6] ..... F25J 3/02

[52] U.S. Cl. ..... 62/650; 62/652; 62/646

[58] Field of Search ..... 62/650, 652, 646, 62/643, 649

[56] References Cited

U.S. PATENT DOCUMENTS

| | | | |
|---|---|---|---|
| 2,753,698 | 7/1956 | Jakob | 62/123 |
| 3,327,488 | 6/1967 | Pervier | 62/650 |
| 3,375,673 | 4/1968 | Cimler et al. | 62/650 |
| 4,072,023 | 2/1978 | Springmann | 62/13 |
| 4,410,343 | 10/1983 | Ziemer | 62/29 |
| 4,704,148 | 11/1987 | Kleinberg | 62/24 |
| 4,936,099 | 6/1990 | Woodward et al. | 62/24 |
| 4,966,002 | 10/1990 | Parker et al. | 62/31 |
| 5,309,721 | 5/1994 | Rathbone | 62/39 |
| 5,385,024 | 1/1995 | Roberts et al. | 62/25 |
| 5,475,980 | 12/1995 | Grenier et al. | 62/24 |
| 5,678,427 | 10/1997 | Bonaquist et al. | 62/650 |
| 5,711,167 | 1/1998 | Ha et al. | 62/652 |

FOREIGN PATENT DOCUMENTS

| | | | |
|---|---|---|---|
| 2854508 | 6/1980 | Germany | F25J 3/02 |
| WO8800677 | 1/1988 | WIPO | F25J 3/02 |

*Primary Examiner*—William Doerrler
*Attorney, Agent, or Firm*—Willard Jones, II

[57] ABSTRACT

The present invention relates to a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream. The process of the present invention comprises the steps of: (a) generating work energy which is at least ten percent (10%) of the overall refrigeration demand of the distillation column system; (b) work expanding a process stream to produce additional work energy such that the total work generated along with step (a) exceeds the total refrigeration demand of the cryogenic plant; and (c) using the work which is generated in excess of the refrigeration need of the distillation column system to cold compress a process stream at a temperature lower than the ambient temperature.

44 Claims, 12 Drawing Sheets

EFFICIENT PROCESS TO PRODUCE OXYGEN

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to several methods for efficient production of oxygen by cryogenic air separation. In particular, the present invention relates to cryogenic air separation processes where it is attractive to produce at least a portion of the total oxygen with purity less than 99.5% and, preferably, less than 97%.

There are numerous U.S. patents that teach the efficient production of oxygen with purity less than 99.5%. Two examples are U.S. Pat. Nos. 4,704,148 and 4,936,099.

U.S. Pat. No. 2,753,698 discloses a method for the fractionation of air in which the total air to be separated is prefractionated in the high pressure column of a double rectifier to produce a crude (impure) liquid oxygen (crude LOX) bottoms and a gaseous nitrogen overhead. The so produced crude LOX is expanded to a medium pressure and is completely vaporized by heat exchange with condensing nitrogen. The vaporized crude oxygen is then slightly warmed, expanded against a load of power production and scrubbed in the low pressure column of the double rectifier by the nitrogen condensed within the high pressure column and entered on top of the low pressure column. The bottom of the low pressure column is reboiled with the nitrogen from the high pressure column. This method of providing refrigeration will henceforth be referred to as CGOX expansion. In this patent no other source of refrigeration is used. Thus, the conventional method of air expansion to the low pressure column is replaced by the proposed CGOX expansion. As a matter of fact, it is cited in this patent that the improvement results because additional air is fed to the high pressure column (as no gaseous air is expanded to the low pressure column) and this results in additional nitrogen reflux being produced from the top of the high pressure column. It is stated that the amount of additional nitrogen reflux is equal to the additional amount of nitrogen in the air that is fed to the high pressure column. An improvement in the efficiency of scrubbing with liquid nitrogen in the upper part of the low pressure column is claimed to overcome the deficiency of boil-up in the lower part of the low pressure column.

U.S. Pat. No. 4,410,343 discloses a process for the production of low purity oxygen which employs a low pressure and a medium pressure column, wherein the bottoms of the low pressure column are reboiled against condensing air and the resultant air is fed into both the medium pressure and low pressure columns.

U.S. Pat. No. 4,704,148 discloses a process utilizing high and low pressure distillation columns for the separation of air to produce low purity oxygen and a waste nitrogen stream. Feed air from the cold end of the main heat exchangers is used to reboil the low pressure distillation column and to vaporize the low purity oxygen product. The heat duty for the column reboil and oxygen product vaporization is supplied by condensing air fractions. In this patent the air feed is split into three substreams. One of the substreams is totally condensed and used to provide reflux to both the low pressure and high pressure distillation columns. A second substream is partially condensed with the vapor portion of the partially condensed substream being fed to the bottom of the high pressure distillation column and the liquid portion providing reflux to the low pressure distillation column. The third substream is expanded to recover refrigeration and then introduced into the low pressure distillation column as column feed. Additionally, the high pressure column condenser is used as an intermediate reboiler in the low pressure column.

In international patent application #PCT/US87/01665 (U.S. Pat. No. 4,796,431), Erickson teaches a method of withdrawing a nitrogen stream from the high pressure column, partially expanding this nitrogen to an intermediate pressure and then condensing it by heat exchange against either crude LOX from the bottom of the high pressure column or a liquid from an intermediate height of the low pressure column. This method of refrigeration will now be referred to as nitrogen expansion followed by condensation (NEC). Generally, NEC provides the total refrigeration need of the cold box. Erickson teaches that only in those applications where NEC alone is unable to provide the refrigeration need that supplemental refrigeration is provided through the expansion of some feed air. However, use of this supplemental refrigeration to reduce energy consumption is not taught. This supplemental refrigeration is taught in the context of a flowsheet where other modifications to the flowsheets were done to reduce the supply air pressure. This reduced the pressure of the nitrogen to the expander and therefore the amount of refrigeration available from NEC. In this patent, Erickson also teaches the use of two NEC. The nitrogen from the high pressure column is split into two streams, and each stream is partially expanded to different pressures and condensed against different liquids. For example, one expanded nitrogen stream is condensed against crude LOX and the other is condensed against an intermediate height liquid from the low pressure column. Erickson claims that the use of a second NEC increases the refrigeration output that can be used to power a cold compressor so as to further increase oxygen delivery pressure.

In U.S. Pat. No. 4,936,099, Woodward et al use CGOX expansion in conjunction with the production of low purity oxygen. In this case, gaseous oxygen product is produced by vaporizing liquid oxygen from the bottom of the low pressure column by heat exchange against a portion of the feed air.

In some air separation plants excess refrigeration is naturally available. This is generally for either of two reasons (1) an operating equipment constraint leads to excess flow through the expander, (2) recovery of the product from the distillation system is low and it produces excess waste at an elevated pressure which is then expanded. In such cases, some patents have suggested to use excess refrigeration for compressing a suitable process stream at cryogenic temperatures. This method of compression at cryogenic temperatures will henceforth be referred to as cold compression.

An example of the creation of excess refrigeration due to the first reason and then use of cold compression can be found in U.S. Pat. No. 4,072,023. In this patent, reversing heat exchangers are used to remove water and carbon dioxide from the feed air. A successful operation of such a reversing heat exchanger requires that a balance stream be used. The balance stream is generally drawn from the distillation column system, then partially warmed in the cold part of the main heat exchanger in indirect heat exchange with the incoming feed air, and then expanded in an expander to provide the needed refrigeration. Unfortunately, the flow rate of this balance stream cannot be reduced below a certain fraction of the feed air flow rate. For large size plants where the refrigeration demand per unit of product flow is not that large, the constraint of having a balance stream flow above a certain fraction of the feed air flow produces excess refrigeration. U.S. Pat. No. 4,072,023 teaches to use this excess refrigeration for cold compressing a process stream.

Examples of the creation of excess refrigeration due to the second reason and then use of cold compression can be found in U.S. Pat. Nos. 4,966,002 and 5,385,024. In both of these patents, air is fed near the bottom of a single distillation column to produce high pressure nitrogen. Since a single distillation column with no reboiler at the bottom is used, the recovery of nitrogen is low. This produces a large quantity of oxygen-enriched waste stream at an elevated pressure. A portion of this oxygen-enriched waste stream is partially warmed and expanded to provide the needed refrigeration, and the excess refrigeration is used to cold compress another portion of this waste stream. The cold compressed waste stream is recycled to the distillation column.

In U.S. Pat. No. 5,475,980, cold compression is used to improve the efficiency of cooling in the heat exchanger vaporizing pumped liquid oxygen at a pressure greater than about 15 bar. For this purpose, an auxiliary stream at an intermediate temperature is taken out from an intermediate location of the heat exchanger. This auxiliary stream is then cold compressed and reintroduced in the heat exchanger and further cooled. At least a portion of the further cooled stream is then expanded in an expander. When the pressure of the auxiliary stream to be cold compressed is much higher than the high pressure column pressure, only a portion of it is expanded to the high pressure column after cold compression and partial cooling. In this case, extra energy is provided at the warm end of the plant to meet the refrigeration and cold compression requirement. However, when the auxiliary stream is withdrawn from the high pressure column then all of it is expanded after cold compression and cooling. This ensures that most of the energy needed for cold compression is recovered from the expander and used for cold compression. As a result, the need for extra vapor flow through the expander to create work energy is minimal and it does not require excess refrigeration as in the earlier cited U.S. Pat. Nos. 4,072,023; 4,966,002 and 5,385,024.

In DE 28 54 508, a portion of the air feed at the high pressure column pressure is further compressed at the warm level by using work energy from the expander providing refrigeration to the cold box. This further compressed air stream and is then partially cooled and expanded in the same expander that drives the compressor. In this scheme, the fraction of the feed air stream which is further compressed and then expanded for refrigeration is the same. As a result, for a given fraction of the feed air, more refrigeration is produced in the cold box. The patent teaches two methods to exploit this excess refrigeration: (i) to produce more liquid products from the cold box; (ii) to reduce flow through the compressor and the expander and thereby increase flow to the high pressure column. It is claimed that an increased flow to the high pressure column would result in a greater product yield from the cold box.

BRIEF SUMMARY OF THE INVENTION

The present invention relates to a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream. The process of the present invention comprises the steps of: (a) generating work energy which is at least ten percent (10%) of the overall refrigeration demand of the distillation column system by at least one of the following two methods: (1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product; (ii) one of the liquid feeds to this distillation column having an oxygen concentration equal to or preferably greater than the concentration of oxygen in the feed air; and (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream; (b) work expanding a third process stream to produce additional work energy such that the total work generated along with step (a) exceeds the total refrigeration demand of the cryogenic plant and if the third process system is the same as the first process system in step (a)(1) then at least a portion of the third process stream after work expansion is not condensed against either of the two liquid streams described in step (a)(1); and (c) using the work which is generated in excess of the refrigeration need of the distillation column system to cold compress a process stream at a temperature lower than the ambient temperature.

BRIEF DESCRIPTION OF SEVERAL VIEWS OF THE DRAWINGS

In FIGS. 1 through 9, common streams use the same stream reference numbers.

DETAILED DESCRIPTION OF THE INVENTION

Figure 1:
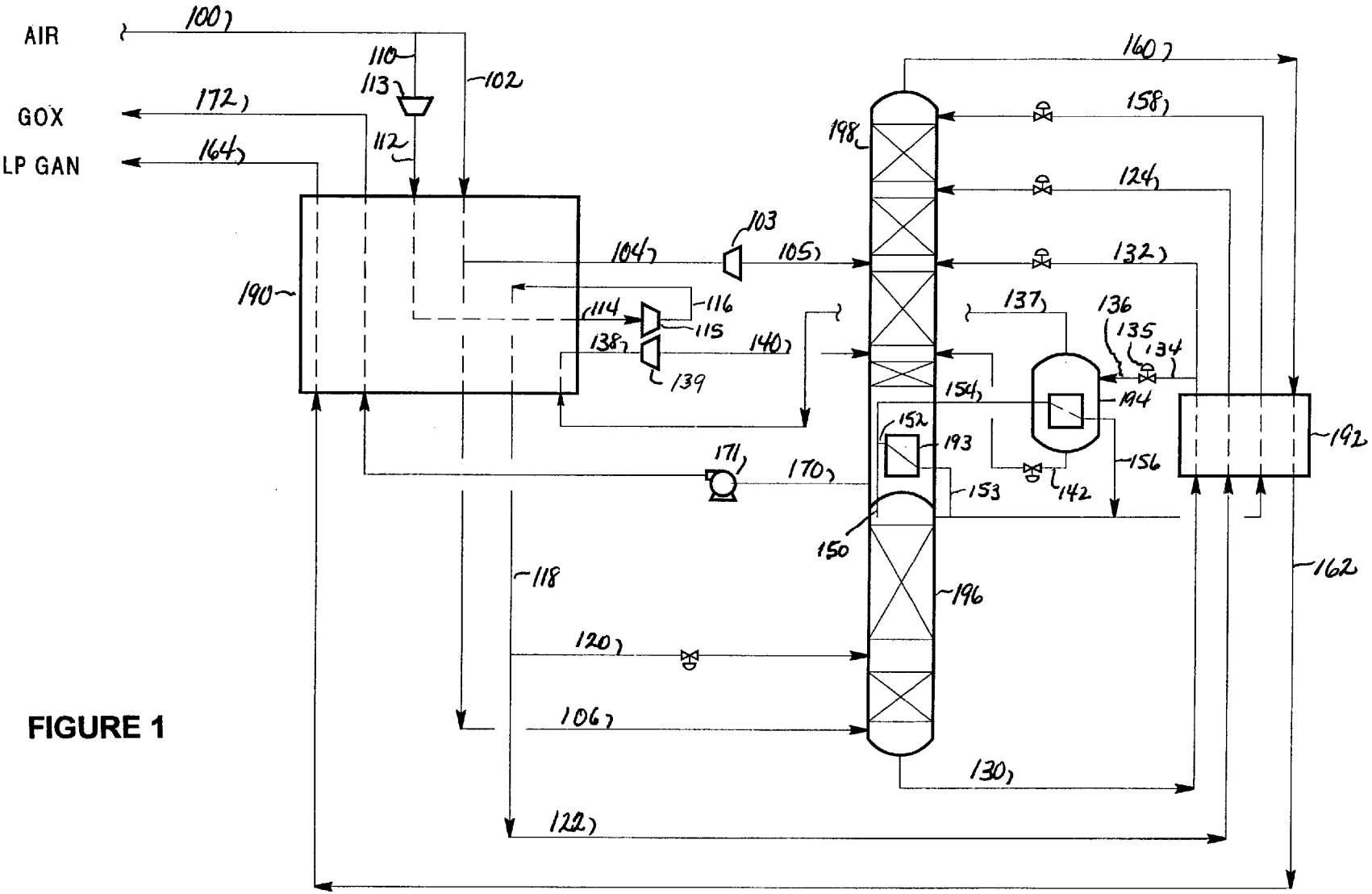
FIGS. 1 through 9 illustrate schematic diagrams of different embodiments of the present invention.

The present invention teaches more efficient cryogenic processes for the production of low purity oxygen. The low-purity oxygen is defined as a product stream with oxygen concentration less than 99.5% and preferably less than 97%. In this method, the feed air is distilled by a distillation system that contains at least one distillation column. The boil-up at the bottom of the distillation column producing the oxygen product is provided by condensing a stream whose nitrogen concentration is either equal to or greater than that in the feed air stream. The invention is comprised of the following steps:

(a) generating work energy which is at least ten (10%) of the overall refrigeration demand of the distillation column system by at least one of the following two methods:

(1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product; (ii) one of the liquid feeds to this distillation column having an oxygen concentration equal to or preferably greater than the concentration of oxygen in the feed air;

(2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream;

(b) work expanding a third process stream to produce additional work energy such that the total work generated along with step (a) exceeds the total refrigeration demand of the cryogenic plant and if the third process system is the same as the first process system in step (a)(1) then at least a portion of the third process stream after work expansion is not condensed against either of the two liquid streams described in step (a)(1); and (c) using the work which is generated in excess of the refrigeration need of the distillation column system to cold compress a process stream at a temperature lower than the ambient temperature.

In the preferred mode, only one of the methods of work expansion from steps (a)(1) and (a)(2) is used; also the second process stream in step (a)(2) will often be the same as the first process stream in step (a)(1).

In the most preferred mode, the distillation system is comprised of a double column system consisting of a high pressure (HP) column and a low pressure (LP) column. At least a portion of the feed air is fed to the HP column. The product oxygen is produced from the bottom of the LP column. The first process stream in step (a)(1) or the second process stream in (a)(2) is generally a high pressure nitrogen-rich vapor stream withdrawn from the HP column. If the work expansion method of step (a)(1) is used then the high pressure nitrogen-rich vapor stream is expanded and then condensed by latent heat exchange against a liquid stream at an intermediate height of the LP column or the crude liquid oxygen (crude LOX) stream that originates at the bottom of the HP column and forms the feed to the LP column. In this method, the pressure of the crude LOX stream is dropped to the vicinity of the LP column pressure. The high pressure nitrogen-rich stream can be partially warmed prior to expansion. If the work expansion method of step (a)(2) is used, then the high pressure nitrogen-rich stream is condensed by latent heat exchange against at least a portion of the crude LOX stream that is at a pressure higher than the LP column pressure; and the resulting vapor from the at least partial vaporization of the crude LOX is work expanded to the LP column. Prior to the work expansion, the resulting vapor from the at least partial vaporization of the crude LOX could be partially warmed. As an alternative to the crude LOX vaporization, an oxygen-enriched liquid with oxygen content greater than air could be withdrawn from the LP column and pumped to the desired pressure greater than the LP column pressure prior to at least partial vaporization.

When the most preferred mode of the double column system is used, then the third process stream in step (b) can be any suitable process stream. Some examples include: work expansion of a portion of the feed air to the HP column and/or the LP column; work expansion of a nitrogen-rich product stream that is withdrawn from the HP column; and work expansion of a stream withdrawn from the LP column.

By work expansion, it is meant that when a process stream is expanded in an expander, it generates work. This work may be dissipated in an oil brake, or used to generate electricity or used to directly compress another process stream.

Along with low-purity oxygen, other products can also be produced. This includes high purity oxygen (purity equal to or greater than 99.5%), nitrogen, argon, krypton and xenon. If needed, some liquid products such as liquid nitrogen, liquid oxygen and liquid argon could also be coproduced.

Now the invention will be described in detail with reference to FIG. 1. The compressed feed air stream free of heavier components such as water and carbon dioxide is shown as stream 100. The pressure of this compressed air stream is generally greater than 3.5 bar absolute and less than 24 bar absolute. The preferred pressure range is from 5 bar absolute to about 10 bar absolute. A higher feed air pressure is helpful in reducing the size of the molecular sieve beds used for water and carbon dioxide removal. The feed air stream is divided into two streams 102 and 110. The major fraction of stream 102 is cooled in the main heat exchanger 190 and then fed as stream 106 to the bottom of the higher pressure (HP) column 196. The feed to the high pressure column is distilled into high pressure nitrogen vapor stream 150 at the top and the crude liquid oxygen (crude LOX) stream 130 at the bottom. The crude LOX stream is eventually fed to a lower pressure (LP) column 198 where it is distilled to produce a lower-pressure nitrogen vapor stream 160 at the top and a liquid oxygen product stream 170 at the bottom. Alternatively, oxygen product may be withdrawn from the bottom of the LP column as vapor. The liquid oxygen product stream 170 is pumped by pump 171 to a desired pressure and then vaporized by heat exchange against a suitably pressurized process stream to provide gaseous oxygen product stream 172. In FIG. 1, the suitably pressurized process stream is a fraction of feed air in line 118. The boil-up at the bottom of the LP column is provided by condensing a first portion of the high pressure nitrogen stream from line 150 in line 152 to provide first high pressure liquid nitrogen stream 153.

According to step (a)(2) of the invention, at least a portion of the crude LOX stream having a concentration of oxygen greater than that in feed air is reduced in pressure across valve 135 to a pressure which is intermediate of the HP and LP column pressures. In FIG. 1, prior to pressure reduction, crude LOX is subcooled in subcooler 192 by heat exchange against the returning gaseous nitrogen stream from the LP column. This subcooling is optional. The pressure-reduced crude LOX stream 136 is sent to a reboiler/condenser 194, where it is at least partially boiled by the latent heat exchange against the second portion of the high pressure nitrogen stream from line 150 in line 154 (the second process stream of (a)(2) of the invention) to provide the second high pressure liquid nitrogen stream 156. The first and second high pressure liquid nitrogen streams provide the needed reflux to the HP and LP columns. The vaporized portion of the pressure-reduced crude LOX stream in line 137 (hereinafter referred as crude GOX stream) is partially warmed in the main heat exchanger 190 and then work expanded in expander 139 to the LP column 198 as additional feed. Partial warming of crude GOX stream 137 is optional and similarly, after work expansion stream 140 could be further cooled prior to feeding it to the LP column.

According to step (b) of the invention, a portion of the partially cooled air stream is withdrawn as stream 104 (the third process stream) from the main heat exchanger and work expanded in expander 103 and then fed to the LP column. Both expanders 103 and 139 generate more work than is needed for the refrigeration balance of the plant. In a cryogenic air separation plant, all the heat exchangers, distillation columns and the associated valves, pipes and other equipment shown in FIG. 1 are enclosed in an insulated box called the cold box. Since the inside of the box is at subambient temperatures, there is a heat leak from the ambient to the cold box. Also, the product streams (such as streams 164 and 172) leaving the cold box are at lower temperatures than the feed air streams. This leads to enthalpy losses due to products leaving the cold box. For a plant to operate, it is essential that both these losses be balanced by extracting an equal amount of energy out from the cold box. Generally, this energy is extracted as work energy. In this invention the work output from both the expanders 103 and 139 exceeds the work that must be extracted to keep the cold box in refrigeration balance. This intentionally generated additional work is then used for cold compression of a process stream within the cold box. This way the additional work does not leave the cold box and the refrigeration balance is maintained.

In FIG. 1, in order to vaporize the pumped liquid oxygen from pump 171, a portion of the feed air stream 100 in stream 110 is further boosted in an optional booster 113 and cooled against cooling water (not shown in the figure) and then partially cooled in the main heat exchanger 190. This partially cooled air stream 114 is then cold compressed by cold compressor 115. The energy input in the cold compressor is the additional work energy generated from expanders 103 and 139 (i.e. that not needed for refrigeration). The cold compressed stream 116 is then reintroduced in the main heat exchanger where it cools by heat exchange against the pumped liquid oxygen stream. A portion of the cooled liquid air stream 118 is sent to the HP column and another portion (stream 122) is sent to the LP column after some subcooling in subcooler 192.

Several known modifications can be applied to the example flowsheet in FIG. 1. For example, all the crude LOX stream 130 from the HP column may be sent to the LP column and none of it is sent to the reboiler/condenser 194. In lieu of this, a liquid is withdrawn from an intermediate height of the LP column and then pumped to a pressure intermediate of the HP and LP column pressures and sent to the reboiler/condenser 194. The rest of the treatment in reboiler/condenser 194 is analogous to that of stream 134 explained earlier. In another modification, the two high pressure nitrogen streams 152 and 154 condensing in reboiler/condenser 193 and 194, respectively, may not originate from the same point in the HP column. Each one may be obtained at different heights of the HP column and after condensation in their reboilers (193 and 194), each is sent to an appropriate location in the distillation system. As one example, stream 154 could be drawn from a position which is below the top location of the high pressure column, and after condensation in reboiler/condenser 194, a portion of it could be returned to an intermediate location of the HP column and the other portion is sent to the LP column.

Figure 2:
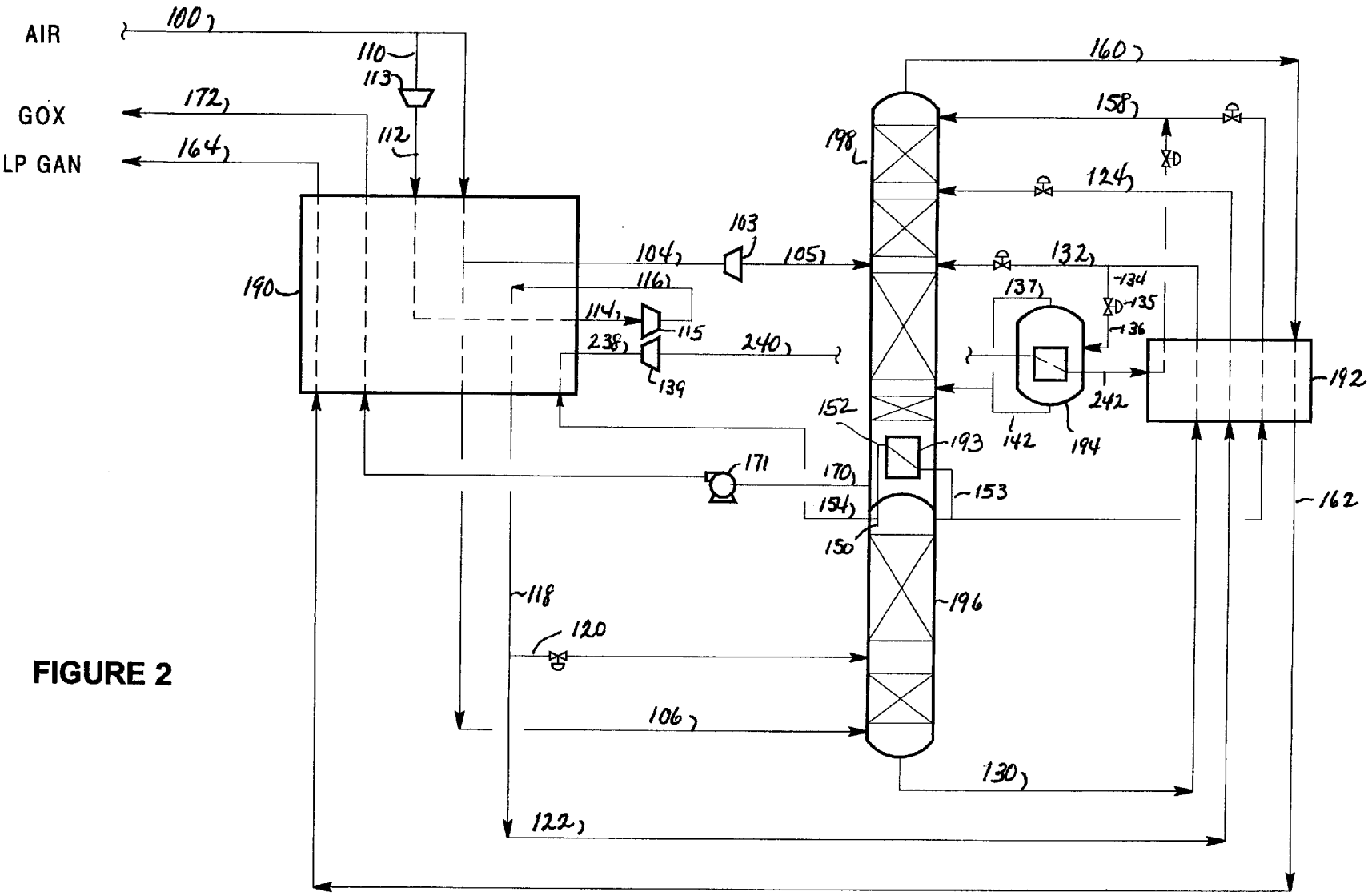

FIG. 2 shows an alternative embodiment where a process stream is work expanded according to step (a)(1). Here subcooled crude LOX stream 134 is let down in pressure across valve 135 to a pressure that is very close to the LP column pressure and then fed to the reboiler/condenser 194. The second portion of the high pressure nitrogen stream in line 154 (now the first process stream of step (a)(1)) is partially warmed (optional) in the main heat exchanger and then work expanded in expander 139 to provide a lower pressure nitrogen stream 240. This stream 240 is then condensed by latent heat exchange in reboiler/condenser 194 to provide stream 242, which after some subcooling is sent to the LP column. The vaporized stream 137 and the liquid stream 142 from the reboiler/condenser 194 are sent to an appropriate location in the LP column. If needed, a portion of the condensed nitrogen stream in line 242 could be pumped to the HP column. Once again, the two nitrogen streams, one condensing in reboiler/condenser 193 and the other condensing in reboiler/condenser 194, could be drawn from different heights of the HP column and could therefore be of different composition.

Figure 3:
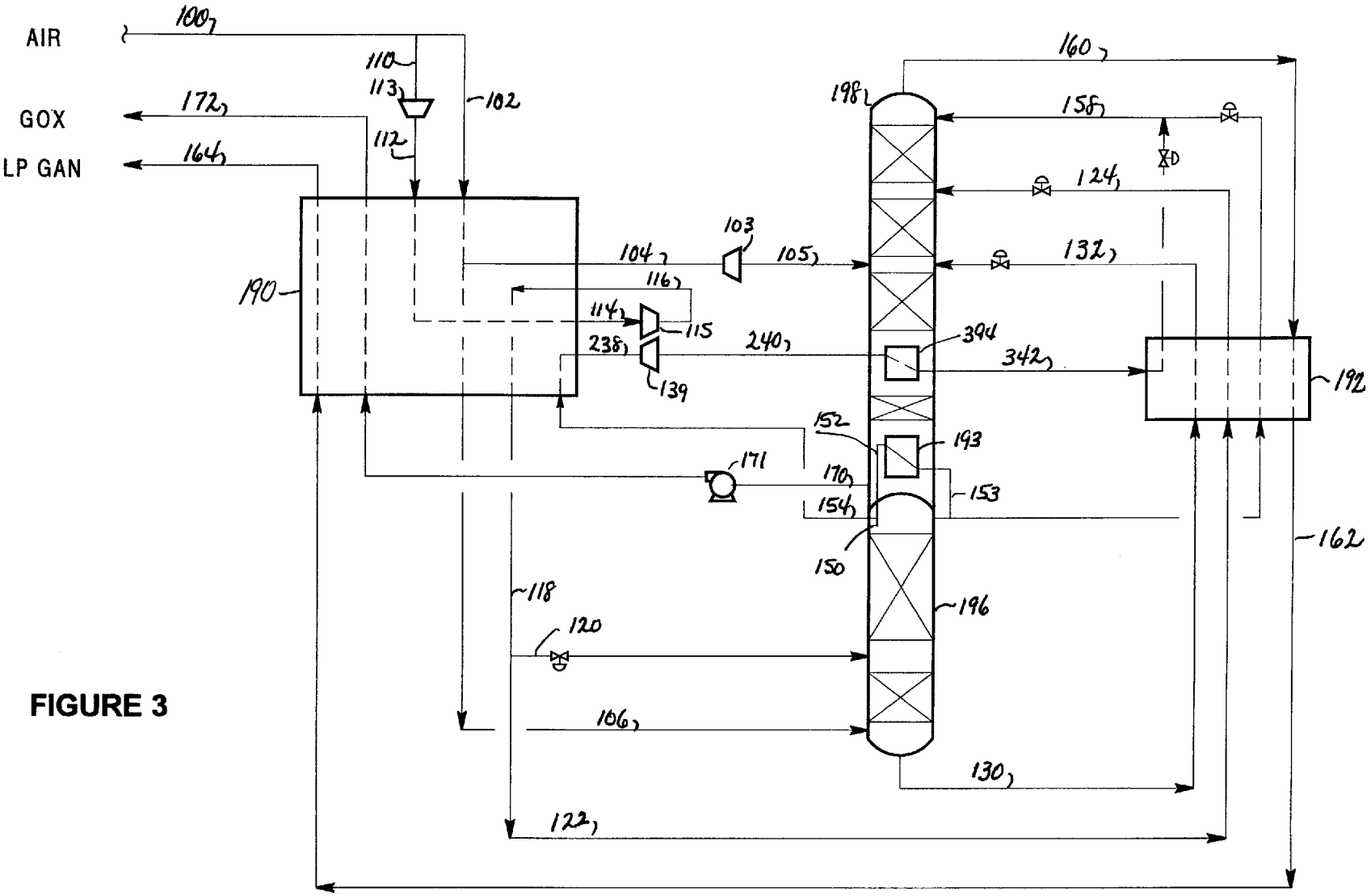

Another variation of FIG. 2 using the work expansion according to step (a)(1) is shown in FIG. 3. In this scheme, reboiler/condenser 194 is eliminated and all of the crude LOX stream from the bottom of the HP column is sent without any vaporization to the LP column. In place of reboiler/condenser 194, an intermediate reboiler 394 is used at an intermediate height of the LP column. Now the work expanded nitrogen stream 240 from expander 139 is condensed in reboiler/condenser 394 by latent heat exchange against a liquid at the intermediate height of the LP column. The condensed nitrogen stream 342 is treated in a manner which is analogous to that in FIG. 2. The other operating features of FIG. 3 are also the same as in FIG. 2.

It is possible to draw several variations of the proposed invention in FIGS. 1–3. Some of these variations will now be discussed as further examples.

Figure 4:
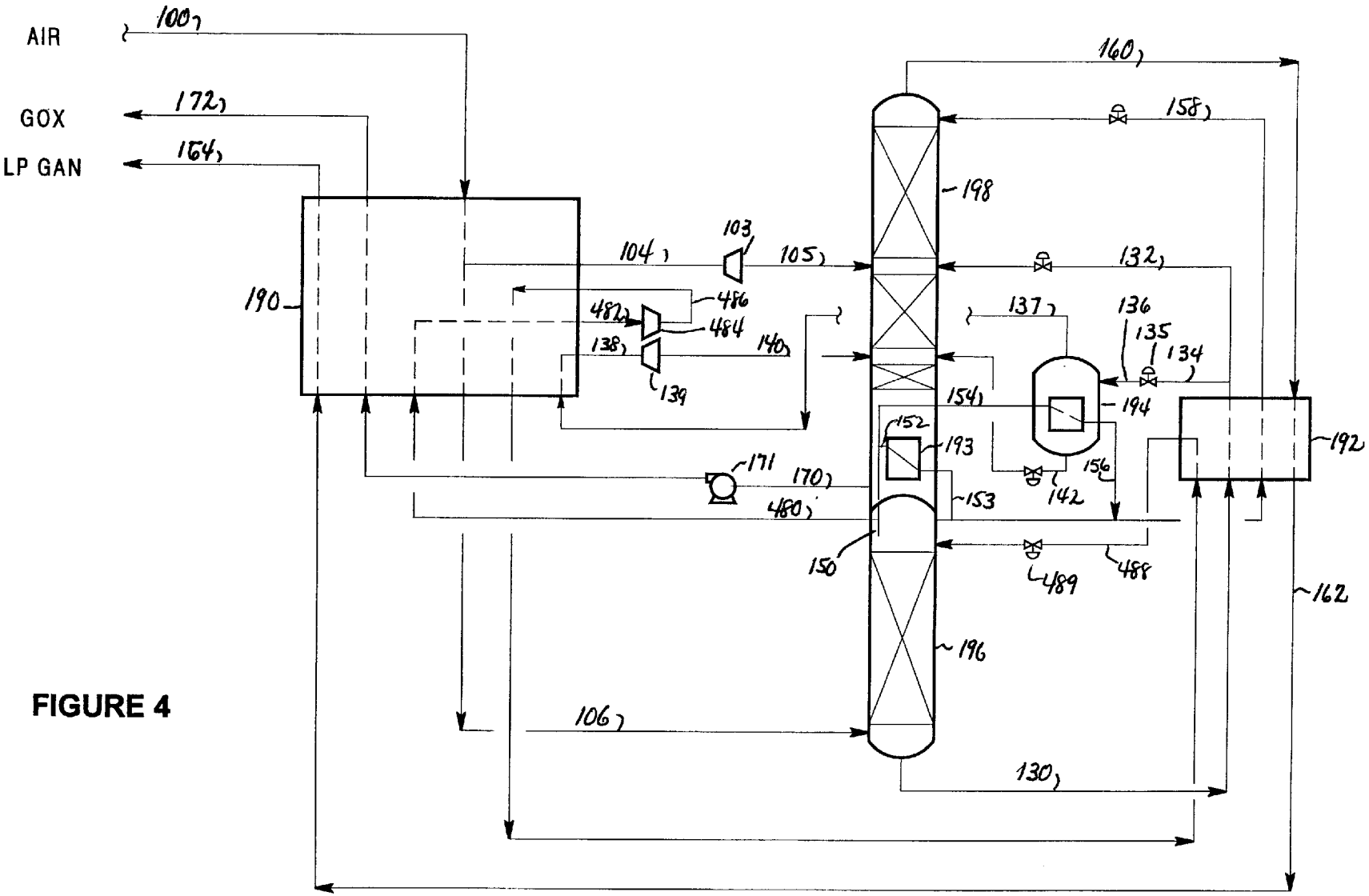

The additional work energy extracted from the two expanders can be used to cold compress any suitable process stream. While FIGS. 1–3 show the cold compression of a portion of the feed air stream which is then condensed against the pumped LOX stream, it is possible to directly cold compress a gaseous oxygen stream. This gaseous oxygen stream may be directly withdrawn from the bottom of the LP column or it could be obtained after the pumped LOX from pump 171 has been vaporized against a suitable process stream. It is also possible to cold compress a stream rich in nitrogen. This nitrogen-rich vapor stream for cold compression can come from any source such as LP column or HP column. FIG. 4 shows a variation where this nitrogen-rich vapor stream is withdrawn from the HP column. All the features of FIG. 4 are same as FIG. 1 except that pumped liquid oxygen from pump 171 is not vaporized by latent heat exchange against a cold compressed air stream but against the cold compressed nitrogen stream from the HP column. While the nitrogen-rich stream for cold compression can be withdrawn from any suitable location of the HP column, in FIG. 4 it is shown to be withdrawn from the top of the HP column as stream 480. This stream 480 is then partially warmed (optional) in the main heat exchanger, cold compressed in 484, then condensed by latent heat exchange against the vaporizing liquid oxygen from pump 171. This condensed stream 487 is then sent to the distillation column system. In FIG. 4, if needed, nitrogen-rich stream 480 could be first warmed in the main heat exchanger to a temperature close to the ambient temperature and then boosted in pressure by an auxiliary compressor, then partially cooled in the main heat exchanger and then sent to the cold compressor 484. The advantage of cold compressing a nitrogen-rich stream and then condensing it against at least a portion of the liquid oxygen from pump 171 is that it provides significantly more nitrogen reflux to the distillation column system and this improves the recovery and/or purity of nitrogen product. For example, even though not shown in FIG. 4, one will be able to coproduce more high pressure nitrogen product from FIG. 4 than from the corresponding FIG. 1.

Figure 5:
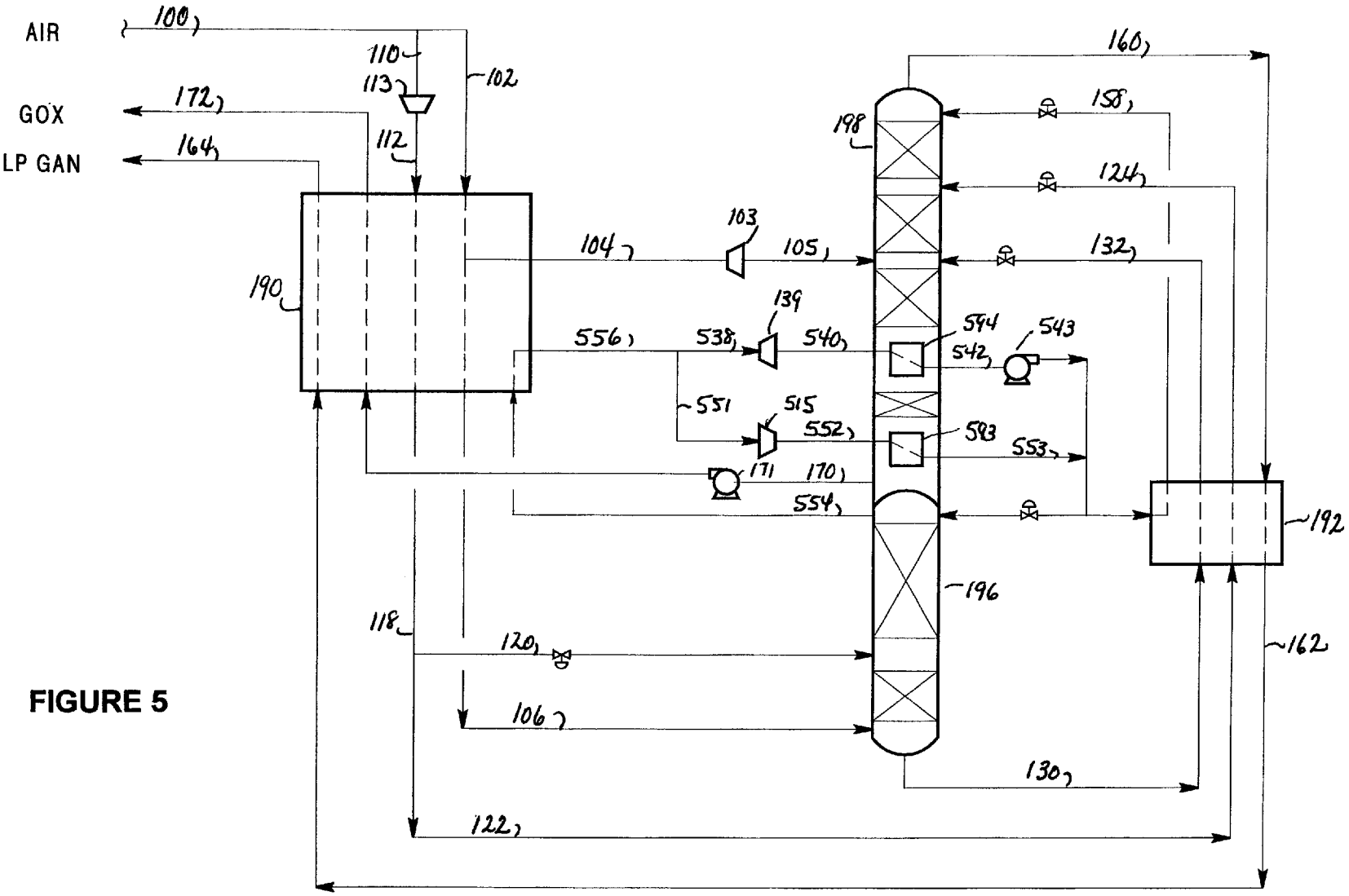

It should be emphasized that the purpose of cold compression is not limited to raising the pressure of oxygen. It can be used to cold compress any suitable process stream in step (c) of the invention. For example, in FIG. 4, either a portion or all of the cold compressed nitrogen stream 486 may not be condensed by further cooling but further warmed in the main heat exchanger to provide a pressurized nitrogen product stream. Another example is shown in FIG. 5. The difference between this example and the one in FIG. 3 is that all the high pressure nitrogen stream from the top of the HP column 196 is withdrawn in line 554. This stream is then partially warmed in the main heat exchanger (stream 556) and divided into two streams 538 and 551. While stream 538 is further treated in a manner analogous to treatment of stream 238 in FIG. 3, stream 551 is cold compressed according to step (c) of the invention. The cold compressed stream 552 is not condensed against the pumped liquid oxygen from pump 171, but is condensed by latent heat exchange against the liquid in the bottom reboiler/condenser 593 of the LP column. This provides the needed boil-up at the bottom of the LP column. The condensed liquid nitrogen streams in line 542 and 553 are then sent as reflux to the HP and LP columns. If a portion of the lower pressure liquid nitrogen stream 542 is to be sent to the HP column, then a pump 543 would be helpful. In another variation, high pressure nitrogen stream 551 for cold compression may be withdrawn immediately from stream 554. Similarly, the cold compressed nitrogen stream in line 552 may be partially cooled by heat exchange against any suitable process stream prior to condensation in reboiler/condenser 593. These examples clearly illustrate that the present invention can be used to cold compress any suitable process stream. Furthermore, 538 and 551 need not be of the same composition, i.e. each could be drawn from different locations of the HP column.

Figure 6:
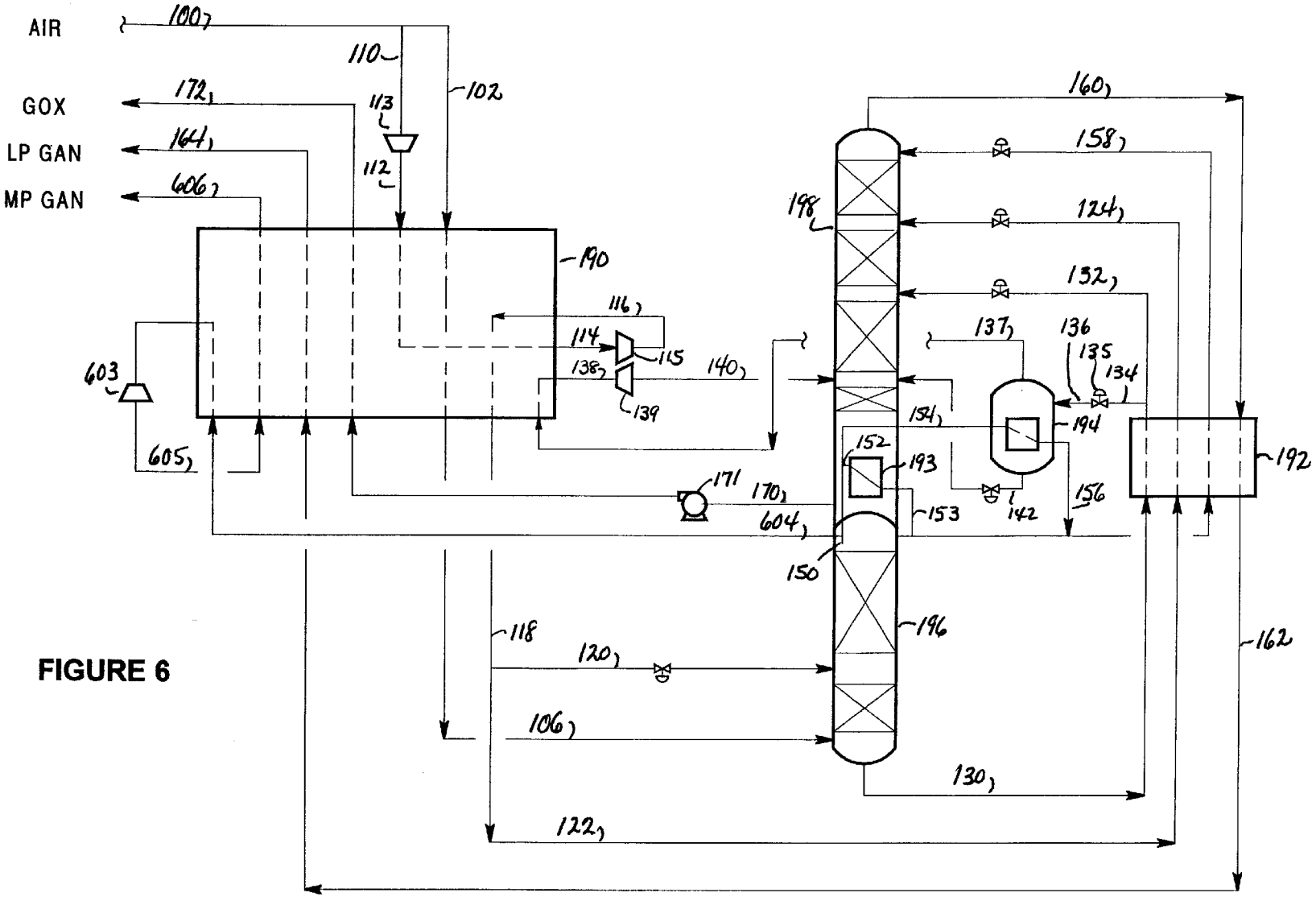

In FIGS. 1–5, expansion of a portion of the feed air to the LP column is done to meet the requirement of step (b) of the invention. As stated earlier, any suitable process stream may be expanded to meet the requirement of this step of the invention. Some examples include: work expansion of air to the HP column and work expansion of a stream from the LP or the HP column. FIG. 6 shows an example where a nitrogen-rich stream from the HP column is work expanded. FIG. 6 is analogous to FIG. 1 except that lines for streams 104 and 105 are eliminated. Instead, a portion of the high pressure nitrogen vapor is withdrawn from the top of the HP column in line 604. This stream is now the third process stream according to step (b) of the invention. The high pressure nitrogen in stream 604 is partially warmed in the main heat exchanger and then work expanded in expander 603. The work expanded stream 605 is then warmed in the main heat exchanger to provide a lower pressure nitrogen stream in line 606. The pressure of nitrogen stream 606 may be the same or higher than the nitrogen in stream 164.

Figure 7:
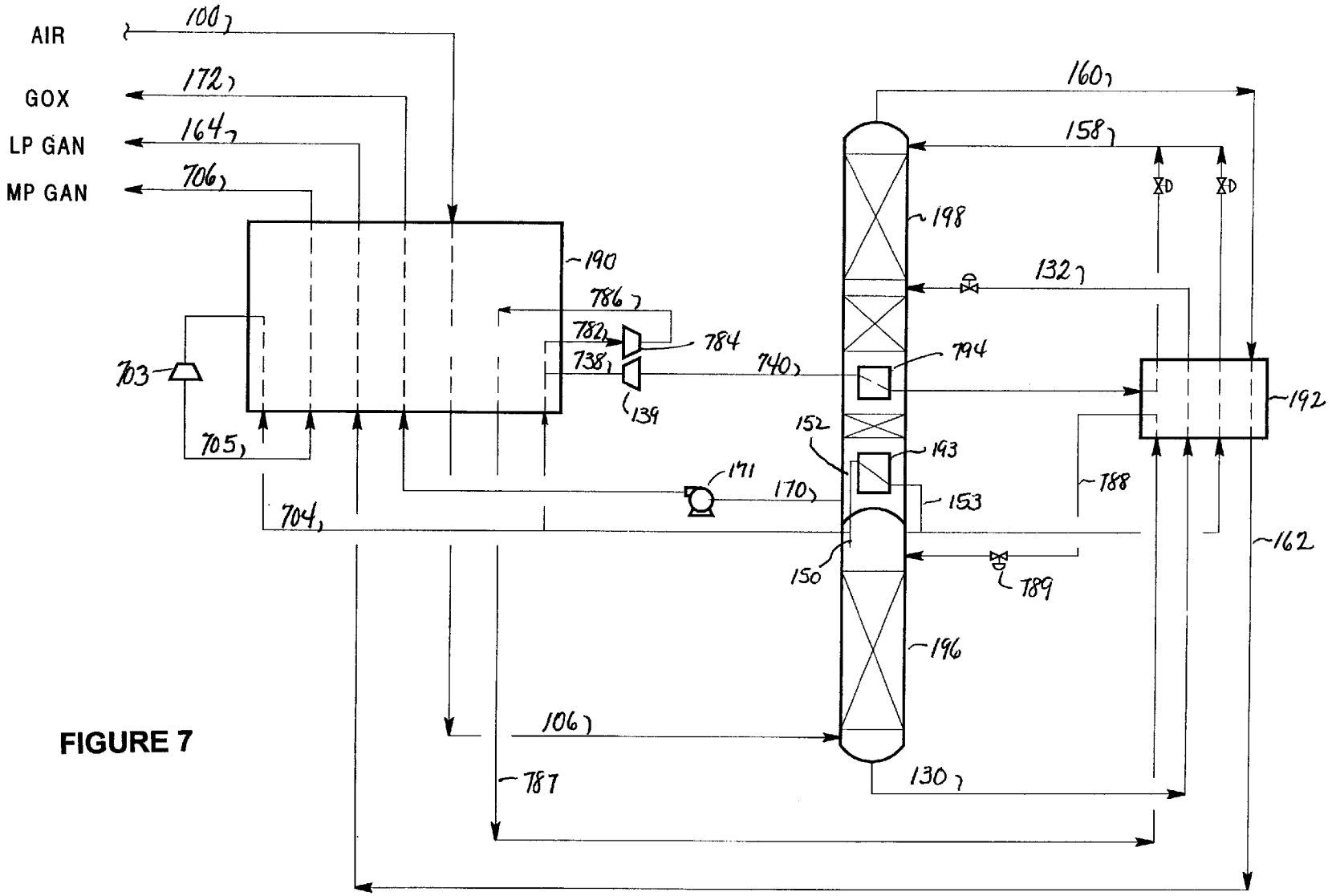

FIGS. 1–6 show examples where all the first or the second process stream, the third process stream and the cold compressed process stream in steps (a), (b), (c) of the invention do not originate from the same process stream. At least two of these streams have different composition. While such schemes with different process streams can now be easily drawn, FIG. 7 shows an example where all the streams for all the three steps of the invention are drawn from the top of the HP column. A portion of the high pressure nitrogen from the top of the HP column is withdrawn in line 754. This stream is then divided into two streams 704 and 780 and both are partially warmed to their respective suitable temperatures in the main heat exchanger. After partial warming of stream 780, it is further divided into two streams 738 and 782. Stream 738 provides the first process stream of step (a)(1) of the invention and is treated in a manner analogous to that of stream 238 in FIG. 3. Stream 704 provides the third process stream of step (b) of the invention and is treated in a manner analogous to that of stream 604 in FIG. 6. Stream 782 provides the needed process stream for cold compression in step (c) of the invention and is processed in a manner analogous to stream 482 in FIG. 4. Note that in FIG. 7, the work expanded nitrogen stream 705 from expander 703, is not condensed against any oxygen-rich liquid from or to the LP column in a manner taught for step (a)(1) of the invention.

Figure 8:
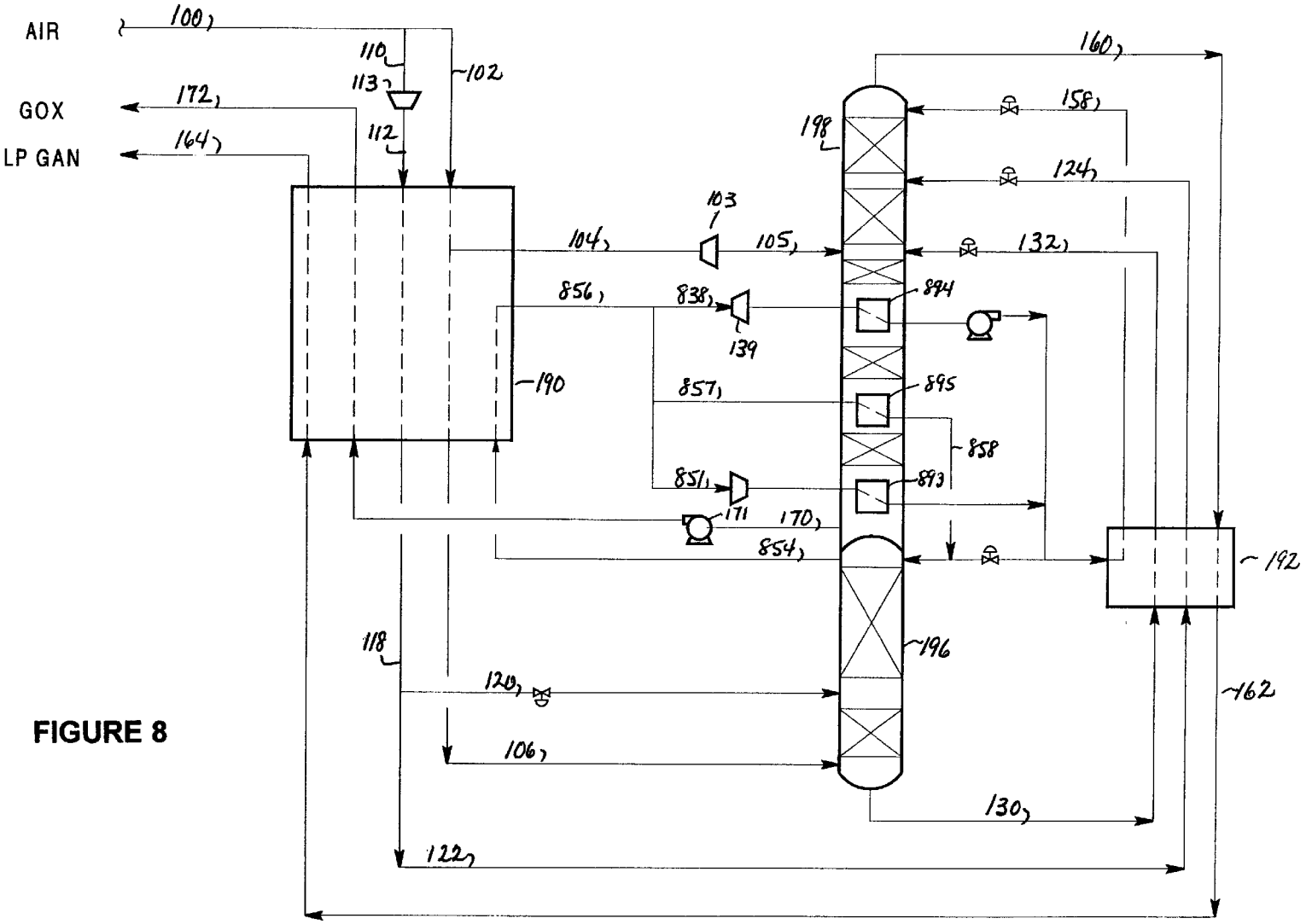

So far, all the example flowsheets show at least two reboiler/condensers. However, it should be emphasized that the present invention does not preclude the possibility of using additional reboiler/condensers in the LP column than those shown in FIGS. 1–7. If needed, more reboilers/condensers may be used in the bottom section of the LP column to further distribute the generation of vapor in this section. Any suitable process stream may be either totally or partially condensed in these additional reboilers/condensers. For illustration, FIG. 8 shows an example where the process in FIG. 5 is modified to include another reboiler/condenser in the LP column. While reboilers/condensers 893 and 894 are analogous to reboilers/condensers 593 and 597, reboiler/condenser 895 is the additional reboiler/condenser. Now partially-warmed high pressure nitrogen stream 856 (analogous to stream 556) is divided into three streams. The additional stream in line 857 is condensed in the additional reboiler/condenser 895 against a liquid stream in the LP column and sent for refluxing the high pressure column. Further processing of streams 838 and 851 is the same as for streams 538 and 551 in FIG. 5. FIG. 8 is just an example of using multiple reboilers/condensers in the LP column. From the known art, it is easy to draw many such examples using the present invention. For illustration, one may consider the possibility of partially or totally condensing a portion of the feed air in the bottom reboiler/condenser 893. Also, the possibility of condensing a vapor stream withdrawn from an intermediate height of the HP column in a reboiler/condenser located in the LP column may be considered. In such situations, when either an air stream or a stream withdrawn from HP column that contains significant quantities of oxygen is partially condensed, the uncondensed vapor fraction can provide the first process stream of step (a)(1) or the second process stream of step (a)(2).

In all those process schemes of the present invention, where work is extracted by the method taught in step (a)(1), all of the first process stream after work expansion may not be condensed by latent heat exchange as taught by step (a)(1). A portion of this stream may be recovered as a product stream or used for some other purpose in the process scheme. For example, in the process schemes shown in FIGS. 2–3, 5, 7–8, at least a portion of the high pressure nitrogen stream from the high pressure column is work expanded in expander 139 according to the step (a)(1) of the invention. A portion of the stream exiting the expander 139 may be further warmed in the main heat exchanger and recovered as a nitrogen product at medium pressure from any one of these process flowsheets.

Figure 9:
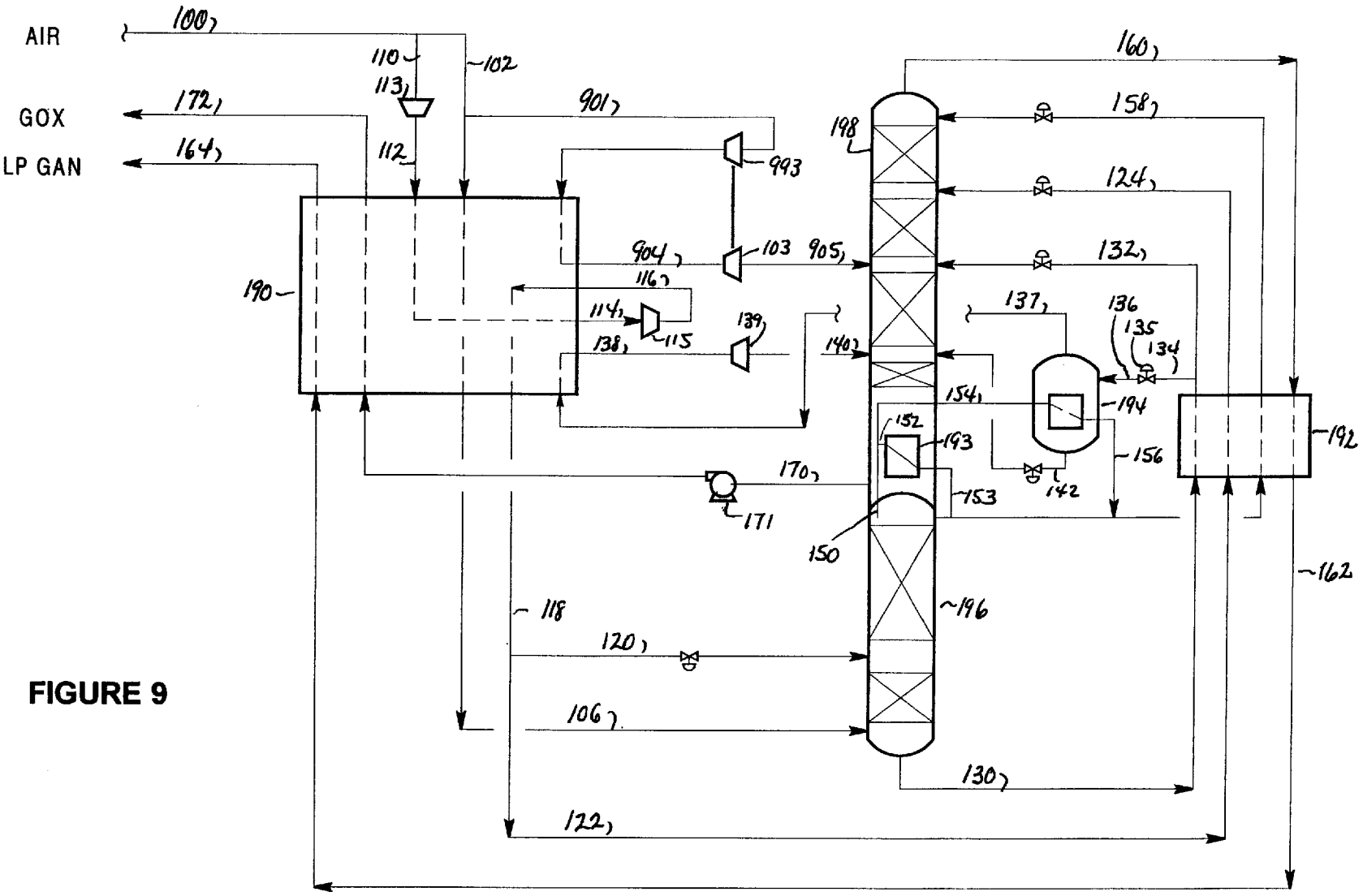

When a portion of the feed air is work expanded, it may be precompressed at near ambient temperatures, prior to feeding it to the main heat exchanger, by using the work energy that is extracted from the cold box. For example, FIG. 9 shows the process scheme of FIG. 1 except that stream 901 is withdrawn from the portion of the feed air in line 102. The withdrawn stream is then boosted in compressor 993, then cooled with cooling water (not shown in the figure) and further cooled in the main heat exchanger to provide stream 904. This stream 904 is further treated in a manner analogous to the treatment of stream 104 in FIG. 1. The work energy needed to drive compressor 993 is derived from the expanders in the cold box. In FIG. 9, it is shown that compressor 993 is solely driven by expander 103. An advantage of using such a system is that it provides a potential to extract more excess work from the expanders and therefore, more work energy would be available for cold compression. As an alternative to pressure boosting of a portion of the feed air stream in line 901, it is possible to first warm other process streams which are to be work expanded in the cold box, boost their pressure in a compressor such as 993, partially cool them in appropriate heat exchangers and then feed them to appropriate expanders.

There are several methods of transferring extra work energy to the cold compressor. For illustration purpose, some of the alternative methods are listed below:

All the work extracted from both the expanders in steps (a) and (b) of the invention may be used external to the cold box and the cold compressor in step (c) of the invention may be driven by an electric motor. For this purpose, either one or both of the expanders may be generator loaded to generate electricity or loaded with a warm compressor to compress a process stream at ambient or above ambient temperatures.

All the work extracted from one of the expanders may be recovered external to the cold box and then all the work extracted from the second expander can be used for cold compression. In such a case, the second expander may be directly coupled with the cold compressor through a common shaft to directly transfer the work from the expanded stream to the cold compressed stream. For example in FIG. 1, expander 139 may be directly coupled with cold compressor 115 such that it is driven only by expander 139. In such a case, work extracted from expander 103 provides the total refrigeration of the cold box. When suitable, instead of expander 139, expander 103 could be directly coupled to the cold compressor 115 and now expander 139 would provide the needed refrigeration for the plant.

It may be possible to directly couple both the expanders to the cold compressor. In such a case, both the expanders will impart at least a portion of the work needed for the cold compression. Also, at least one of the expanders will be loaded external to the cold box to provide the needed refrigeration for the cold box.

The cold compressor is directly coupled to an expander and uses up all the work extracted from this expander. The second expander is loaded external to the cold box such that all the work extracted from this expander is rejected outside the cold box. Now consider a case where work extracted from the second expander exceeds the refrigeration demand of the cold box. In such a case, the excess work extracted from the second expander can be transferred to the cold compressor through an electric motor assist.

Figure 10:
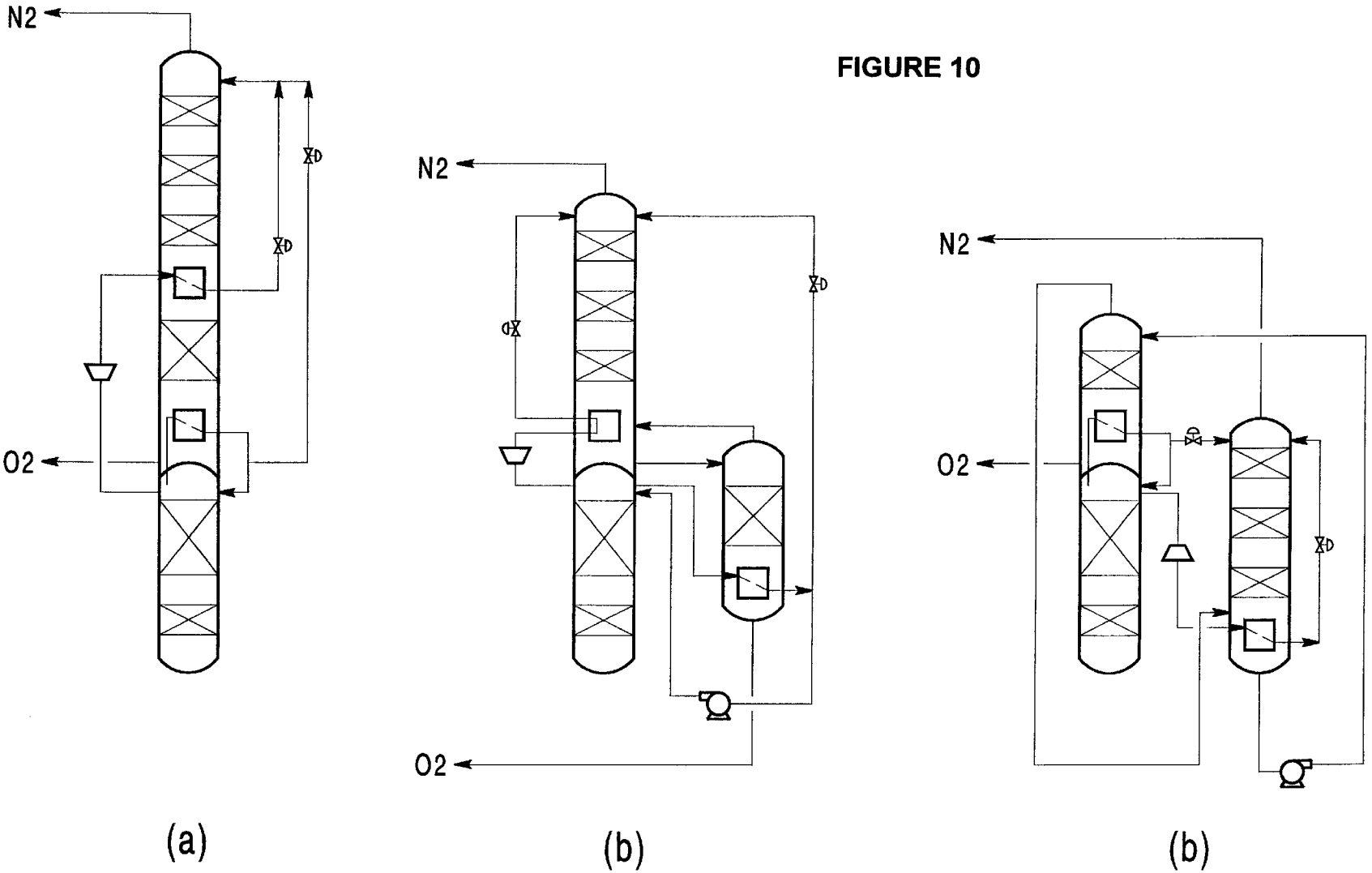
FIGS. 10(*a*) through 10(*c*) illustrate schematic diagrams of embodiments of the present invention as configured for use with multiple low pressure distillation columns.

It should be apparent to those practicing the art that a single distillation column containing multiple reboilers may be broken into multiple columns, each with one reboiler. The justification for splitting a multi-reboiler column into multiple sections is generally capital cost savings. An example of how this invention may be implemented using multiple low pressure columns is shown in FIG. 10. FIG. 10(*a*) is a simplified representation of the process shown in FIG. 3, numerous process lines and unit operations have been omitted for clarity. The low pressure column shown in FIG. 10(*a*) contains three distillation sections above the intermediate reboiler and one section below. In FIG. 10(*b*), the section below the intermediate reboiler, and the bottom reboiler, have been relocated to a separate column. Because of elevation differences, it is necessary to add a transfer pump. The advantage of the configuration shown in FIG. 10(*b*) is that the height of the equipment has been reduced. In FIG. 10(*c*), the sections above and including the intermediate reboiler have been relocated to a separate column. The configuration shown in FIG. 10(*c*) results in the lowest equipment height. Reducing the equipment height can be advantageous when the distillation columns are large and the resultant cost savings often offset the capital penalty associated with adding a transfer pump.

Finally, the method taught in this invention can be used when there are coproducts besides the low-purity oxygen, with oxygen content less than 99.5%. For example, a high purity (99.5% or greater oxygen content) oxygen could be coproduced from the distillation system. One method of accomplishing this task is to withdraw low-purity oxygen from the LP column at a location which is above the bottom and withdraw a high purity oxygen from the bottom of the LP column. If the high purity oxygen stream is withdrawn in the liquid state, it could then be further boosted in pressure by a pump, then vaporized by heat exchange against a suitable process stream. Similarly, a high purity nitrogen product stream at elevated pressure could be coproduced. One method of accomplishing this task would be to take a portion of the condensed liquid nitrogen stream from one of the suitable reboiler/condensers and pump it to the required pressure and then vaporize it by heat exchange with a suitable process stream.

The value of the present invention is that it leads to substantial reduction in the energy consumption. This will be demonstrated by comparing it with some known prior art processes, which are listed below.

Figure 11:
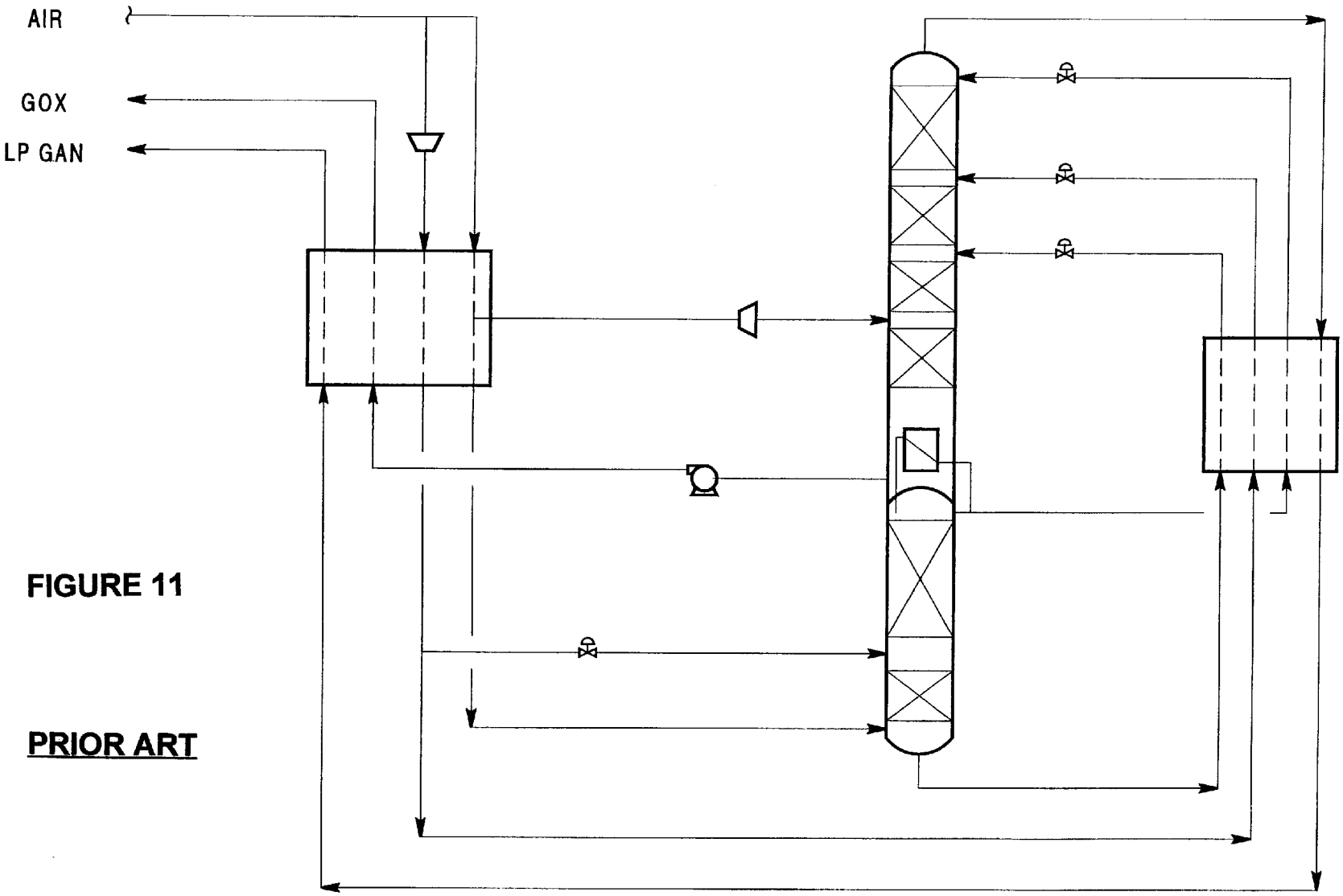
FIGURE 11 PRIOR ART
FIGS. 11 and 12 illustrate schematic diagrams of two prior art processes.

The first prior art process is shown in FIG. 11. This is a conventional double column process with an air expander to the LP column. The work energy from the air expander is recovered as electrical energy. The process of FIG. 11 can be easily derived from the process of FIG. 3 by eliminating cold compressor 115, expander 139 and reboiler/condenser 394 and the associated lines.

The second prior art process is derived on the basis of Erickson's PST/US87/011665 (U.S. Equivalent U.S. Pat. No. 4,796,431). For this purpose, from the process of FIG. 2, cold compressor 115 is eliminated. Also, the air expander 103 is eliminated. Therefore, only one expander 139 is retained to supply the total refrigeration need of the plant. In accordance with Erickson's teaching, the discharge from expander 139 is condensed against a portion of the pressure reduced crude LOX stream 136 in reboiler/condenser 194. The condensed nitrogen stream 242 is sent as reflux to the LP column and streams 137 and 142 from the boiling side of the reboiler/condenser 194 are sent to the LP column.

The third prior art process is also derived from Erickson's PCT/US87/01665 (U.S. Equivalent U.S. Pat. No.

Figure 12:
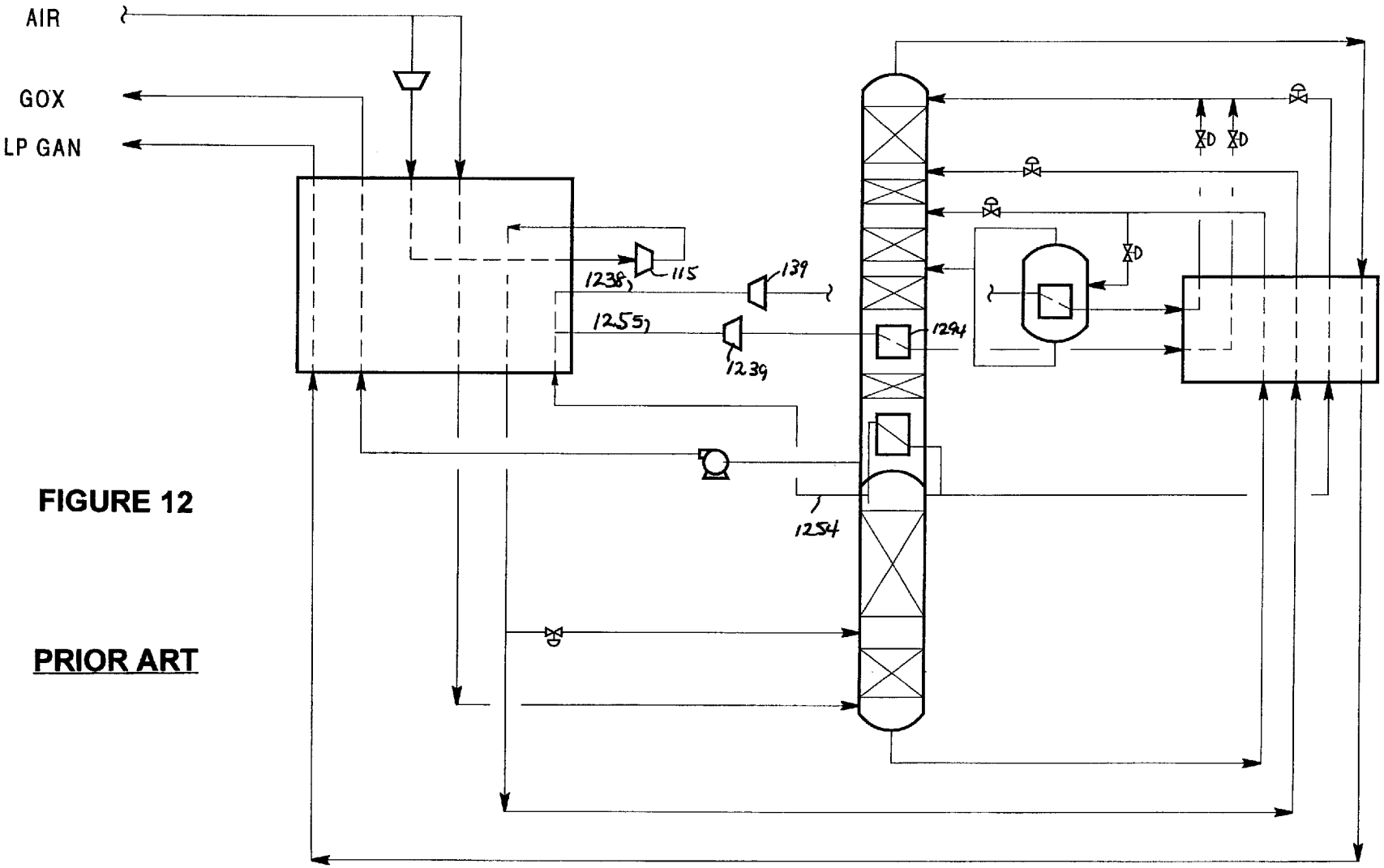
FIGURE 12 PRIOR ART

4,796,431) and is shown in FIG. 12. In this figure, all the refrigeration is provided by work expansion of the high pressure nitrogen from the top of the HP column. Therefore, any air expander such as expander 103 in FIG. 2 is not used. However, the high pressure nitrogen stream 1254 from the HP column is divided into two streams 1238 and 1255 and each one is work expanded according to the method described in each of the FIGS. 2 and 3. Thus, stream 1238 is work expanded and treated analogous to stream 238 in FIG. 2, and stream 1255 is work expanded and treated analogous to stream 238 in FIG. 3. The excess work extracted from both expanders is used in cold compressor 115 in a manner shown in FIGS. 2 and 3.

A fourth process for comparison is derived from FIG. 1 by retaining everything in FIG. 1 except cold compressor 115. Therefore, the work generated from both the expanders 139 and 103 is used to generate electricity. No cold compression of any stream is done within the cold box.

Calculations were done to produce 95% oxygen product at 200 psia. For all flowsheets, the discharge pressure from the final stage of the main feed air compressor was about 5.3 bar absolute. The pressure at the top of the LP column was about 1.25 bar absolute. The net power consumption was computed by calculating the power consumed in the main feed air compressor, the booster air compressor 113 to vaporize pumped liquid oxygen, and taking credit for electrical power generated from any expander. The relative power consumption for several flow schemes are listed below:

| Case | Flow Scheme | Relative Power |
|---|---|---|
| 1 | First Prior Art Process (Figure 11) | 1.0 |
| 2 | Second Prior Art Process | 1.013 |
| 3 | Third Prior Art Process (Figure 12) | 1.001 |
| 4 | Fourth Prior Art Process (Figure 1 with no cold compression) | 0.986 |
| 5 | Present Invention, Figure 1 | 0.946 |
| 6 | Present Invention, Figure 2 | 0.957 |

It is clear from these calculations that the process of the present invention is much superior to any of the prior art processes used for Cases 1 through 3. Also, when Cases 4 and 5 are compared, the huge benefit derived due to cold compression becomes obvious. This is because between these two cases, all the features of the flowsheets are the same except that in Case 4 no cold compression is used, whereas, Case 5 uses cold compression. Another flowsheet according to the present invention in FIG. 2 shows substantial improvement, specifically when compared to the prior art process in Case 3 (FIG. 12). The superior performance of the present invention is now clear.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

We claim:

1. In a process for the cryogenic distillation of pressurized feed air in a distillation column system enclosed in a cold box that contains at least one distillation column wherein the boil-up at the bottom of the distillation column producing the oxygen product is provided by condensing a stream whose nitrogen concentration is equal to or greater than that in the feed air stream, the improvement comprising the steps of:

(a) generating work energy which is at least ten percent (10%) of the overall refrigeration demand of the distillation column system by at least one of the following two methods:

(1) work expanding a first process stream with a nitrogen content equal to or greater than that in the pressurized feed air and then condensing at least a portion of the expanded stream by latent heat exchange with at least one of the two liquids: (i) a liquid at an intermediate height in the distillation column producing oxygen product; (ii) one of the liquid feeds to this distillation column having an oxygen concentration equal to or preferably greater than the concentration of oxygen in the pressurized feed air; and (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the pressurized feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream;

(b) work expanding a third process stream to produce additional work energy such that the total work generated along with step (a) exceeds the total refrigeration demand of the cryogenic plant and if the third process system has the same source in the process as the first process system in step (a)(1) then at least a portion of the third process stream after work expansion is not condensed against either of the two liquid streams described in step (a)(1); and (c) using the work which is generated in excess of the refrigeration need of the distillation column system to cold compress a process stream at a temperature lower than the ambient temperature.

2. The process according to claim 1 wherein at least a double column system containing a higher pressure column and lower pressure column is employed.

3. The process according to claim 2 wherein the first process stream in step (a)(1) is a vapor stream withdrawn from the higher pressure column.

4. The process according to claim 2 wherein the first process stream in step (a)(1) is a portion of feed air.

5. The process according to claim 2 wherein the first process stream in step (a)(1) is the vapor resulting from the partial condensation of at least a portion of feed air.

6. The process according to claim 2 wherein said first process stream is condensed by at least partially vaporizing a liquid derived from an intermediate location of the lower pressure column.

7. The process according to claim 2 wherein said first process stream is condensed by at least partially vaporizing at least a portion of an oxygen enriched liquid which is withdrawn from the higher pressure column.

8. The process according to claim 2 wherein said first process stream is condensed by at least partially vaporizing at least a portion of an oxygen enriched liquid which is derived from at least partially condensing at least a portion of the feed air.

9. The process according to claim 2 wherein at least a portion of said first process stream is pumped and sent to the higher pressure column after condensation.

10. The process according to claim 2 wherein at least a portion of said first process stream is pumped and vaporized in a heat exchanger to provide a product.

11. The process according to claim 2 wherein all of said first process stream is sent to the lower pressure column as a feed after condensation.

12. The process according to claim 2 wherein the second process stream in step (a)(2) is a vapor withdrawn from the higher pressure column.

13. The process according to claim 2 wherein the second process stream in step (a)(2) is a portion of feed air at a pressure less than the higher pressure column.

14. The process according to claim 2 wherein the second process stream in step (a)(2) is the vapor resulting from the partial condensation of at least a portion of feed air and said vapor is at a pressure less than the higher pressure column.

15. The process according to claim 2 wherein said second process stream has been turbo expanded prior to condensation.

16. The process according to claim 2 wherein said second process stream is condensed by at least partially vaporizing a liquid derived from an intermediate location of the lower pressure column and said liquid is pumped prior to vaporization.

17. The process according to claim 2 wherein said second process stream is condensed by at least partially vaporizing at least a portion of an oxygen enriched liquid which is withdrawn from the higher pressure column.

18. The process according to claim 2 wherein said second process stream is condensed by at least partially vaporizing at least a portion of an oxygen enriched liquid which is derived from at least partially condensing at least a portion of the feed air.

19. The process according to claim 2 wherein at least a portion of said second process stream is pumped, if necessary, and sent to the higher pressure column after condensation.

20. The process according to claim 2 wherein at least a portion of said second process stream is pumped and vaporized in a heat exchanger to provide a product.

21. The process according to claim 2 wherein all of said second process stream is sent to the lower pressure column as a feed after condensation.

22. The process according to claim 2 wherein the third process stream is a portion of the feed air.

23. The process according to claim 2 wherein the third process stream is the vapor that remains after the partial condensation of at least a portion of feed air.

24. The process according to claim 2 wherein said third process stream is eventually fed to either the lower pressure column, the higher pressure column, or both.

25. The process according to claim 2 wherein the third process stream is a vapor withdrawn from the higher pressure column.

26. The process according to claim 25 wherein said vapor withdrawn from the higher pressure column is warmed and discharged from the cold box following expansion.

27. The process according to claim 25 wherein said vapor withdrawn from the higher pressure column is eventually fed to the lower pressure column as a vapor feed after expansion.

28. The process according to claim 2 wherein said vapor withdrawn from the higher pressure column is warmed to near ambient and compressed external to the cold box, then cooled and reintroduced to the cold box prior to expansion.

29. The process according to claim 2 wherein the third process stream is a vapor withdrawn from the lower pressure column and said vapor is warmed and discharged from the cold box after expansion.

30. The process according to claim 2 wherein the third process stream is a vapor withdrawn from the lower pressure column said vapor is warmed to ambient and compressed external to the cold box, then cooled and reintroduced to the cold box prior to expansion.

31. The process according to claim 2 wherein the process stream to be compressed in step (c) is at least a portion of feed air.

32. The process according to claim 31 wherein the oxygen product is withdrawn from the lower pressure column as a liquid and eventually boiled and said feed air used for step (c), after cold compression, is at least partially condensed by indirect heat exchange with the boiling oxygen.

33. The process according to claim 32 wherein said feed air used for step (c) is also compressed warm prior to being cooled and subsequently compressed cold.

34. The process according to claim 2 wherein the process stream to be compressed in step (c) is a vapor withdrawn from the higher pressure column.

35. The process according to claim 34 wherein the oxygen product is withdrawn from the lower pressure column as a liquid and eventually boiled and at least a portion of said higher pressure column vapor for step (c) after cold compression is at least partially condensed by indirect heat exchange with the boiling oxygen.

36. The process according to claim 34 wherein said higher pressure column vapor for step (c) is warmed to ambient following the cold compression, then further compressed.

37. The process according claim 36 wherein the oxygen product is withdrawn from the lower pressure column as a liquid and eventually boiled and at least a portion of said warm compressed higher pressure column vapor is cooled then at least partially condensed by indirect heat exchange with the boiling oxygen.

38. The process according to claim 34 wherein said higher pressure column vapor for step (c) is warmed to ambient then compressed and at least a portion is subsequently cooled then cold compressed.

39. The process according to claim 38 wherein the oxygen product is withdrawn from the lower pressure column as a liquid and eventually boiled and said cold compressed higher pressure column vapor is at least partially condensed by indirect heat exchange with the boiling oxygen.

40. The process according to claim 34 wherein at least a portion of said higher pressure column vapor for step (c) constitutes a nitrogen enriched product.

41. The process according to claim 34 wherein said higher pressure column vapor for step (c) is at least partially condensed in the main reboiler-condenser located in the lower pressure column following cold compression.

42. The process according to claim 2 wherein the process stream to be compressed in step (c) is a vapor withdrawn from the top of lower pressure column and constitutes a nitrogen-enriched product.

43. The process according to claim 2 wherein the process stream to be compressed in step (c) is a vapor withdrawn from the bottom of lower pressure column and constitutes an oxygen product.

44. The process according to claim 1 wherein the expander used for step (a) is direct coupled to the cold compressor used in step (c).

* * * * *